United States Patent [19]

Cilloniz Oberti

[11] 3,969,882

[45] July 20, 1976

[54] PROCESS AND APPARATUS FOR FIBER WETTING IN SPINNING DEVICE OF THE RING-SPINDLE-TRAVELER TYPE

[76] Inventor: Manuel Cilloniz Oberti, P.O. Box 544, Lima, Peru

[22] Filed: Sept. 30, 1974

[21] Appl. No.: 510,868

[52] U.S. Cl. ..... 57/35; 57/164

[51] Int. Cl.[2] ..... D01H 13/30

[58] Field of Search ..... 57/7, 35, 36, 164

[56] References Cited

UNITED STATES PATENTS

| | | | |
|---|---|---|---|
| 2,412,641 | 12/1946 | Whittier et al. | 57/35 |
| 2,493,359 | 1/1950 | Painter, Jr. | 57/35 |
| 3,222,857 | 12/1965 | Keyser | 57/35 |

FOREIGN PATENTS OR APPLICATIONS

| | | | |
|---|---|---|---|
| 1,031,190 | 5/1958 | Germany | 57/35 |

*Primary Examiner*—John Petrakes

*Attorney, Agent, or Firm*—Wenderoth, Lind & Ponack

[57] ABSTRACT

A spinning device includes a drafting apparatus for drawing fibers and a ring-spindle-traveler device positioned downstream of the drafting arrangement for receiving the drawn fibers from the drafting apparatus and for twisting the thus drawn fibers and winding the thus twisted fibers around a bobbin. Positioned between the drafting apparatus and the twisting device is an arrangement for wetting the fibers. Thus, the fibers are wetted after they are drawn, but before they are fully twisted.

5 Claims, 3 Drawing Figures

PROCESS AND APPARATUS FOR FIBER WETTING IN SPINNING DEVICE OF THE RING-SPINDLE-TRAVELER TYPE

BACKGROUND OF THE INVENTION

The present invention is directed to an improvement in a fiber spinning device of the ring-spindle-traveler type, wherein fibers are drafted or drawn, then twisted and wound on a bobbin.

The present invention is specifically drawn to an improved such device wherein it is possible to very greatly improve the lubrication of the fibers and to thus very greatly reduce the friction between the fibers and the parts of the machine in contact therewith.

Spinning machines of the ring-spindle-traveler type have been known for some time. In this type of machine, fibers are received from drafting rollers, are passed through a "pigtail" or eyelet opening, and then pass through a traveler which is movable on a ring. The fibers then wrap around a bobbin on a spindle which is rotated. As the spindle and bobbin are rotated, the fibers are wound on the bobbin and cause the traveler to move circumferentially around the bobbin on the ring. The ring is vertically reciprocated by a ring rail. During this operation, twist is imparted to the fibers to improve uniformity and strength thereof.

As herein employed, the term "fibers" is intended to refer to any type of fiber or thread of either natural or man-made materials, in any stage of the formation thereof, which is normally manufactured by a spinning device of the ring-spindle-traveler type. Furthermore, as used herein, the term "spinning" is intended to refer to the operations of both drafting and twisting the fibers.

It is to be understood that the drafting operation is performed to reduce the linear weight of the strand of fibers, and that the twisting operation is performed to strengthen the fibers.

In the operation of spinning devices of this type, it is a continuing problem to increase production output while insuring proper product quality. The problem of increasing production output is dependent upon a great many factors. These factors vary greatly with the specific type of fiber involved. Additionally, production is obviously dependent upon the speed of movement of the fibers and the rotational velocity of the spindle and bobbin.

However, a very substantial limitation to increased speeds results from friction between the fibers and the parts of the device in contact therewith. Spindles and bobbins employed in devices of this type operate at speeds around 10,000 rpm. However, it is well known that spindles and bobbins which are available could operate at speeds of from 12,000 to 20,000 rpm. However, it is not currently practical to operate at these increased speeds due to the friction between the fibers and the elements of the machine and the resultant heat generated by such friction.

More specifically, and particularly with regard to certain synthetic fibers, such as polyester fibers, it is possible to design spindles and travelers which will rotate at substantially higher speeds than are currently employed. However, the friction and heat generated thereby are greater than the resistance of such fibers to heat, and at relatively high speeds such fibers are damaged.

It is known to wet bundles of fibers prior to passing them through a drafting apparatus. Furthermore, it is known to impart twist to fibers while passing such fibers through water.

However, these known processes for wetting fibers suffer from certain inherent disadvantages. Specifically, the first mentioned known process suffers from the disadvantage that it is necessary to pass wetted fiber bundles through the drafting rolls, thereby substantially complicating the drafting operation. Further, the second above mentioned known process suffers from the disadvantage that it is necessary to substantially alter the normal path of travel of the fibers from the roller device to the traveler. This greatly affects the operation of the overall system, and requires substantial capital modifications.

SUMMARY OF THE INVENTION

With the above discussion in mind, it is a primary object of the present invention to provide an improved spinning device of the ring-spindle-traveler type wherein fibers are drafted in the dry state and twisted in the wet state, thereby improving the lubrication properties of the fibers and reducing friction between the fibers and the parts of the machine contacted thereby.

It is a correlatory object of the present invention to provide such a device wherein it is possible to wet the fibers after they are drafted and before they are fully twisted without in any way altering the path of travel of the fibers from the path they would otherwise have without the improvement of the present invention.

It is a futher object of the present invention to provide such a device which results in a reduction in friction between the fibers and the elements of the machine in contact therewith, and the resultant reduction in heat generated by such friction.

The above objects are achieved in accordance with the present invention by the provision of means located between the exit of the drafting rolls and the eyelet opening for wetting the fibers. Specifically, a supply of wetting liquid is positioned downstream of the outlet of the drafting arrangement and upstream of the eyelet opening through which the fibers pass to the traveler. Such liquid supply is preferably in the form of a trough containing the liquid and having therein an opening for each fiber strand. The fibers pass from the outlet of the drafting apparatus into the liquid, and through the opening in the trough to the "pig tail" or eyelet opening and the traveler, without in any way altering the path of travel of the fibers.

The fibers are thus drafted while dry, but are wet when twisted.

Accordingly, when the fibers contact the "pig tail" or eyelet opening, the balloon shape control device, and the traveler, the fibers are wet. Therefore, the friction between the fibers and these elements is lowered, and greatly reduced heat is generated by such friction. As the fibers pass throgh the opening in the bottom of the liquid containing trough, the fibers carry therewith a certain amount of liquid. When the wetted fibers contact the traveler, the water carried therewith runs down the traveler to the ring, thereby additionally reducing friction between the traveler and the ring. When the fibers pass from the traveler to be wound on the bobbin, they no longer contain excess liquid, but are somewhat moistened. This has the advantage of stabilizing the fibers.

The size of the opening in the bottom of the liquid containing trough will of course vary from installation to installation. Such size will be dependent upon the size or count of the strand of fibers. However, the opening may be made somewhat larger than the diameter of the strand of fibers. In the event of a fiber break, it is possible that the opening be dimensioned such that surface tension of the liquid would prevent liquid leaking through the opening. However, it is additionally contemplated to be within the scope of the present invention to provide a second separate trough below the liquid containing trough for collecting any liquid which leaks through the opening in the liquid containing trough.

It is further contemplated to be within the scope of the present invention to make the opening in the liquid containing trough of an adjustable element or a valve to thereby selectively vary the diameter of such opening. Also, such opening may be formed of an elastic member capable of flexure.

Still further, the liquid containing tray may be of sufficient size to allow the passage therethrough of a plurality of fibers from a plurality of drafting apparatuses.

The wetting liquid will hereinafter be discussed as constituting water. However, it will be understood to be within the scope of the present invention to employ other types of suitable liquids.

The present invention provides for a manner for easily wetting a fiber after drafting but before complete twisting to thereby cool and lubricate the fiber. The wetting is advantageous to certain types of fibers, since the strength thereof is increased. Such wetting is additionally advantageous since certain fibers will therefore have more satisfactory uniformity and greater cohesion, thereby making it possible to reduce the amount of twist necessary. Further, as stated above, friction and heat generated thereby are reduced, with the result that the overall speed of operation may be increased.

BRIEF DESCRIPTION OF THE DRAWINGS

Other objects and features of the present invention will be described in more detail below with reference to the accompanying drawings wherein.

DETAILED DESCRIPTION OF THE INVENTION

Figure 2:
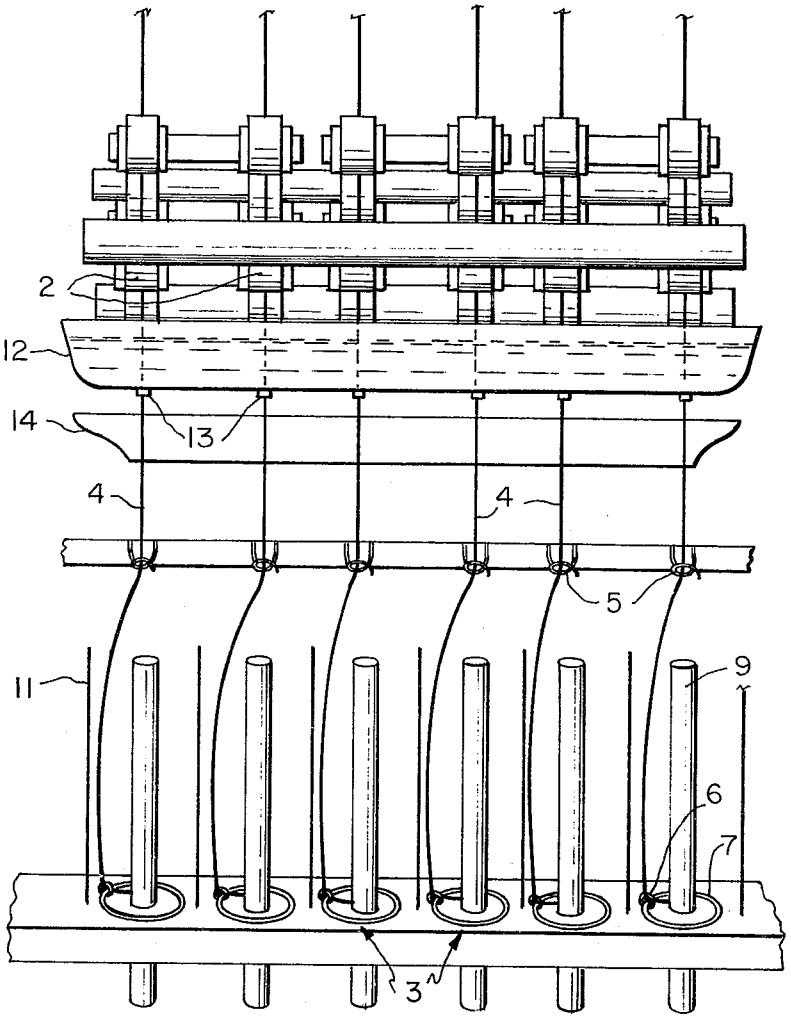
FIG. 2 is a front view of the device of the FIG. 1, but showing a plurality of fiber strands passing through a single liquid containing trough.
Figure 1:
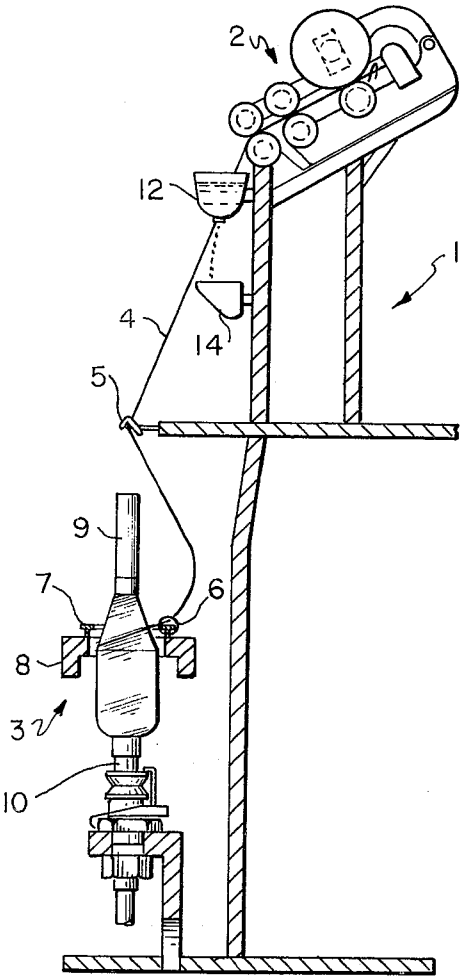
FIG. 1 is a side view, partially in cross-section, of an embodiment of the device of the present invention.
Figure 3:
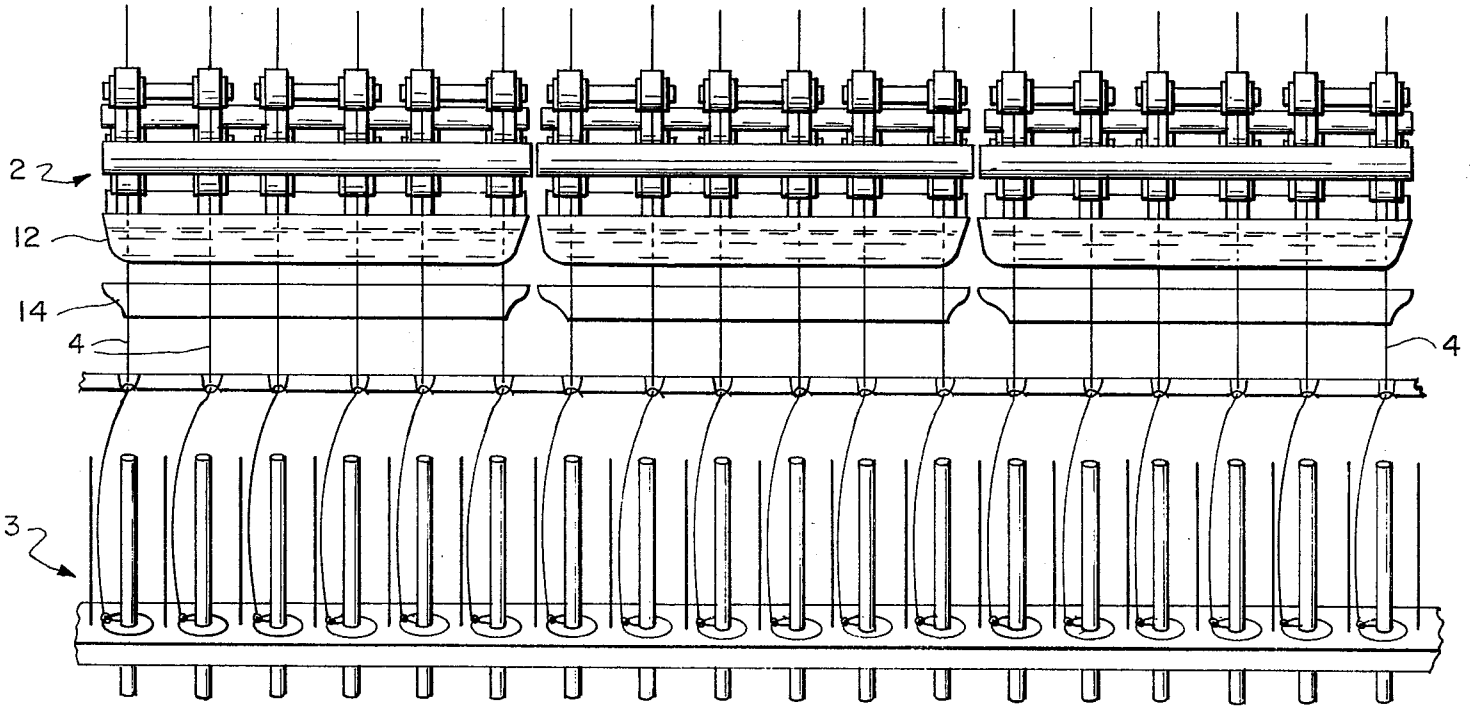
FIG. 3 is front view illustrating modification of the arrangement of FIG. 2, wherein multiple liquid containing troughs are employed.

With reference to the drawings, a known fiber spinning device 1 includes a known fiber drafting or drawing arrangement 2 and a known twist imparting and winding device 3. In the use of spinning machine 1, a fiber strand 4 passes from the outlet rolls of drafting device 2 and passes downwardly through a "pig tail" or eyelet opening 5. The fibers then balloon downwardly and pass through a traveler 6 which is movable on a ring 7 which is mounted on a ring rail 8. The fiber passes through traveler 6 and is wound on a bobbin 9 mounted on a spindle 10. The spindle and bobbin are rotated in a known manner, and ring rail 8 is vertically reciprocated in a known manner.

In the above known arrangement the fiber contacts the "pig tail" or eyelet opening 5, balloon shape control device 11 (see FIG. 2) and traveler 6 before it is wound on the bobbin 9. This contact results in friction between the fiber and these elements. This friction generates heat which is detrimental to the fiber, thereby limiting the maximum speed of movement of the fiber.

In accordance with the present invention, the above described device is modified to reduce such friction and resultant heat.

Specifically, a lubricating and cooling means is positioned between the outlet of the drafting device 2 and the eyelet opening 5. In accordance with the present invention, such lubricating and cooling means wet the fiber strand after it is drafted but before it is twisted. Such lubricating and cooling means specifically comprises a trough or tray 12 containing therein a sufficient supply of a suitable wetting liquid. The fiber strand passes from the outlet of the drafting device through the wetting liquid to the eyelet opening 5. An opening 13 is provided in the trough 12 for the passage of the fiber. As the fiber 4 passes through opening 13 it carries therewith a certain amount of wetting liquid. When the fiber passes through the traveler 6, this excess wetting liquid is removed from the fiber and travels downwardly of the traveler to the rail 7, thereby lubricating and cooling the traveler 6 and rail 7 and thus reducing heat generated therebetween. The wetted condition of the fiber also results in less friction between the fiber and the "pig tail" or eyelet opening 5, the balloon control device 11 and the traveler 6. When the fiber passes from the traveler 6 to be wound on the bobbin 9, it does not carry therewith excess liquid, but it is moistened.

The path of the yarn from drafting device 2 to eyelet opening 5 is not altered by its passage through the wetting means of the present invention. That is, the trough 12 and opening 13 are so positioned that the path of travel of the fibers 4 is the same as such path of travel would be if it were not for the presence of the wetting device of the present invention.

The size of opening 13 will be larger than the diameter of yarn 4. The specific dimension of opening 13 will of course vary from installation to installation and can readily be designed by one of ordinary skill in the art to achieve the above discussed objects. The liquid contained in trough 12 may be water, or any other suitable fiber wetting liquid, such as ammonia or a carbon-contaning liquid. Furthermore, the opening 13 may be provided by a flexible elastic member, or a selectively adjustable member such as a valving element.

In accordance with the present invention, each trough 12 may contain only one opening 13 therein for a single fiber strand. However, in accordance with the arrangement of FIG. 2, the trough 12 contains six openings therein for use with six fiber strands. Also, an actual production arrangement may be established employing a plurality of troughs, each containing therein openings for the passage therethrough of a plurality of fiber strands.

In accordance with the present invention, it will be readily possible for one of ordinary skill in the art to design the size of opening 13 such that if fibers 4 should break, the surface tension of the liquid will be sufficient to prevent such liquid from leaking out of trough 12 trough opening 13. However, it is also comtemplated to be within the scope of the present invention to provide a second, separate trough 14 positioned below openings 13 in trough 12, to collect any liquid which should leak through openings 13.

It will be apparent that many modifications of the specific structural arrangements described above may be made without departing from the spirit or scope of the present invention.

What is claimed is:

1. In a spinning apparatus for drawing and twisting fibers and winding said fibers on a bobbin, said apparatus including:

drafting means for drawing said fibers;

a ring-spindle-traveler device positioned downstream of said drafting means for twisting the fibers drawn by said drafting means and winding the thus twisted fibers on a bobbin; and an eyelet member positioned between said drafting means and said ring-spindle-traveler device, said eyelet member having an eyelet opening through which said fibers pass;

the improvement comprising:

a trough positioned in the path of travel of said fibers between said drafting means and said eyelet member, said trough having therein a fiber wetting liquid, said trough and liquid being spaced from and completely out of contact with said drafting means, said trough having in the bottom thereof opening means for allowing passage therethrough of said fibers, said opening means being of a size greater than the diameter of said fibers, said fibers passing from said drafting means and through said liquid, such that said fibers are wetted after they are drawn by said drafting means and before they pass through said eyelet opening and are twisted by said ring-spindle-traveler device, the path of travel of said fibers from said drafting means, through said liquid, and to said eyelet member being inclined to the vertical.

2. The improvement claimed in claim 1, wherein said opening means comprises an adjustable valve element.

3. The improvement claimed in claim 1, wherein said opening means comprises an elastic element capable of flexure.

4. The improvement claimed in claim 1, further comprising tray means, positioned beneath said trough for collecting any of said liquid leaking through said opening means.

5. In a process for spinning fibers by passing said fibers through a drafting means for drawing said fibers, and passing the thus drawn fibers through an eyelet opening in an eyelet member and to a ring-spindle-traveler device for twisting said fibers and winding the thus twisted fibers on a bobbin; the improvement comprising:

positioning a trough having therein an opening means of a size greater than the diameter of said fibers and containing therein fiber wetting liquid in the path of travel of said fibers between said drafting means and said eyelet member;

maintaining said trough and liquid spaced from and completely out of contact with said drafting means; and passing said fibers through said liquid and said opening means after said fibers are drawn by said drafting means but before the thus drawn fibers pass through said eyelet opening and are twisted by said ring-spindle-traveler device, while maintaining the path of travel of said fibers from said drafting means, through said liquid, and to said eyelet member inclined to the vertical.

* * * * *